United States Patent [19]

Spehrley, Jr. et al.

[11] Patent Number: 4,849,795

[45] Date of Patent: Jul. 18, 1989

[54] SHEET TRANSPORT

[75] Inventors: Charles W. Spehrley, Jr., Whiteriver Junction, Vt.; Robert R. Schaffer, Canaan, N.H.

[73] Assignee: Xerox Corporation, Stamford, Conn.

[21] Appl. No.: 104,743

[22] Filed: Oct. 5, 1987

[51] Int. Cl.[4] ..... G03G 15/00

[52] U.S. Cl. ..... 355/317; 355/271; 355/327; 271/270; 271/202

[58] Field of Search ..... 355/14 SH, 3 SH, 3 R, 355/14 R, 3 TR; 271/277, 270, 202, 203, 110, 111, 259

[56] References Cited

U.S. PATENT DOCUMENTS

| | | | |
|---|---|---|---|
| 3,179,404 | 4/1965 | Felts et al. | 271/57 |
| 4,081,723 | 3/1978 | Vetter et al. | 318/38 |
| 4,210,319 | 7/1980 | Hynes | 271/3.1 |
| 4,326,792 | 4/1981 | Landa | 355/3 TR |
| 4,331,328 | 5/1982 | Fasig | 271/270 |
| 4,436,405 | 3/1984 | Kindt | 355/3 TR |
| 4,552,448 | 11/1985 | Davidson | 355/3 SH |
| 4,568,169 | 2/1986 | Wada et al. | 355/3 SH |

*Primary Examiner*—A. C. Prescott

*Attorney, Agent, or Firm*—Ronald Zibelli

[57] ABSTRACT

An apparatus in which a sheet is advanced into registration with information developed on a moving member. Spaced belts having a sheet gripper secured thereto move the sheet in a recirculating path of movement. The belts move at a first velocity during registration of the sheet with the information on the moving member and at a second velocity during non-registration of the sheet with the information on the moving member.

29 Claims, 3 Drawing Sheets

SHEET TRANSPORT

This invention relates generally to an electrophotographic printing machine, and more particularly concerns a sheet transport for moving a sheet in a recirculating path to enable successive toner powder images to be transferred thereto in superimposed registration with one another.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing marking particles into contact therewith. This forms a powder image on the photoconductive member which is subsequently transferred to a copy sheet. The copy sheet is heated to permanently affix the marking particles thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner particles of a color complimentary thereto. This process is repeated a plurality of cycles for differently colored images and their respective complimentarily colored toner particles. Each single color toner powder image is transferred to the copy sheet in superimposed registration with the prior toner powder image. This creates a multi-layered toner powder image on the copy sheet. Thereafter, the multi-layered toner powder image is permanently affixed to the copy sheet creating a color copy.

Hereinbefore toner powder images have been transferred to the copy sheet by an electrical field created by a corona generating device which induces transfer to the copy sheet by spraying a corona discharge having a polarity opposite to that of the toner particles on the photoconductive surface. This causes the toner particles to be electrically transferred to the copy sheet. However, in transferring multiple toner powder images, each toner powder image must be in superimposed registration with one another in order to produce a color copy which is not blurred. Instead of using a corona generating device, an electrically biased transfer roll may be used. The electrically biased transfer roll generates a high voltage discharge in the proximity of the surface of the copy sheet, or it may be applied by a conductive cylinder in contact with the copy sheet. The copy sheet is interposed between the conductive roller and the photoconductive surface. A charge of opposite polarity from the toner particles is deposited on the backside of the copy sheet which attracts the toner particles thereto. In order to transfer multiple different color toner powder images to the copy sheet in superimposed registration with one another, the copy sheet must be transported in a recirculating path. For example, U.S. Pat. No. 3,612,677 issued to Langdon et al. in 1971 describes an electrically biased transfer roll which employs gripper fingers to secure the copy sheet to the exterior surface thereof for movement therewith in a recirculating path. Similarly, U.S. Pat. No. 4,326,792 issued to Landa in 1982 describes a gripper assembly mounted in the transfer roller of an electrophotographic printing machine. The gripper secures the leading edge of the copy sheet and maintains a grip on the sheet while the transfer roller rotates. Exemplary multi-color electrophotographic printing machines teaching moving the copy sheet in a recirculating path are the Model Numbers 6500 and 1005 made by the Xerox Corporation. Various approaches have been devised for moving sheets. The following disclosures appear to be relevant:

U.S. Pat. No. 3,179,404, Patentee: Felts et al., Issued: Apr. 20, 1965

U.S. Pat. No. 4,081,723, Patentee: Vetter et al., Issued: Mar. 28, 1978

U.S. Pat. No. 4,331,328, Patentee: Fasig, Issued: May 25, 1982

U.S. Pat. No. 4,436,405, Patentee: Kindt, Issued: Mar. 13, 1984

U.S. Pat. No. 4,552,448, Patentee: Davidson, Issued: Nov. 12, 1985

The relevant portions of the foregoing patents may be briefly summarized as follows:

U.S. Pat. No. 3,179,404 discloses a document transporting apparatus designed to move a document rapidly with high positional accuracy. Side plates provide structural support for the apparatus, and the drive system is comprised of a motor, clutch, and timing belt which encircles a drive wheel and idle wheel. A gripper bar is attached to the transporting apparatus by an expandable coupling.

U.S. Pat. No. 4,081,723 describes a sheet transport device with sheet grippers arranged on a carriage which moves from a pick-up station through a printing station to a discharge station. The speed of the carriage is retarded at the pick-up and discharge stations, and accelerated at the printing station to assure synchronization with the printing rollers.

U.S. Pat. No. 4,331,328 discloses a document feeder employing a variable speed servo motor to receive documents of variable lengths. A transport track includes a first set of rollers driven by a servo motor, and a second set of rollers driven at high speeds by the same motor. This forms a gap between successive document, and variable length documents can be handled.

U.S. Pat. No. 4,436,405 describes an apparatus for accurate superposition of transfer images, as in a color electrophotographic copier. A track assembly transports image carrier sheets to successive process stations. At the transfer station a positioning apparatus effects accurate transfer from the image carrier sheets to a receiver member.

U.S. Pat. No. 4,552,448 discloses a sheet gripper which transports a sheet in a recirculating path. The sheet gripper is detachably coupled to a photoconductive drum during transfer to place the copy sheet in registration with the toner powder image thereon. After transfer of the toner powder image from the photoconductive drum to the copy sheet, the gripper is decoupled from the photoconductive drum. Successive toner powder images are transferred to the sheet in superimposed registration with one another.

Pursuant to the features of the present invention, there is provided an apparatus for advancing a sheet into registration with information developed on a moving member. The apparatus includes means for gripping the sheet. Belt means define a continuous path. The gripping means is secured to the belt means to move in unison therewith. Means are provided for moving the belt means so as to move the sheet in a recirculating path of movement. During registration of the sheet with the information on the moving member, the moving means moves the belt means at a first velocity. The moving means moves the belt means at a second velocity during non-registration of the sheet with the information on the moving member.

In accordance with another aspect of the present invention, there is provided a printing machine of the type having a toner image developed on a latent electrostatic charge pattern recorded on a moving member with a sheet being advanced into registration with the toner image. The printing machine includes means for gripping the sheet. Belt means define a continuous path. The gripping means is secured to the belt means to move in unison therewith. Means are provided for moving the belt means so as to move the sheet in a recirculating path of movement. During registration of the sheet with the toner image developed on the moving photoconductive member, the moving means moves the belt means at a first velocity. The moving means moves the belt means at a second velocity during non-registration of the sheet with the toner image on the moving photoconductive member.

Other aspects of the present invention will become apparent as the following description proceeds and upon reference to the drawings, in which.

Figure 1:
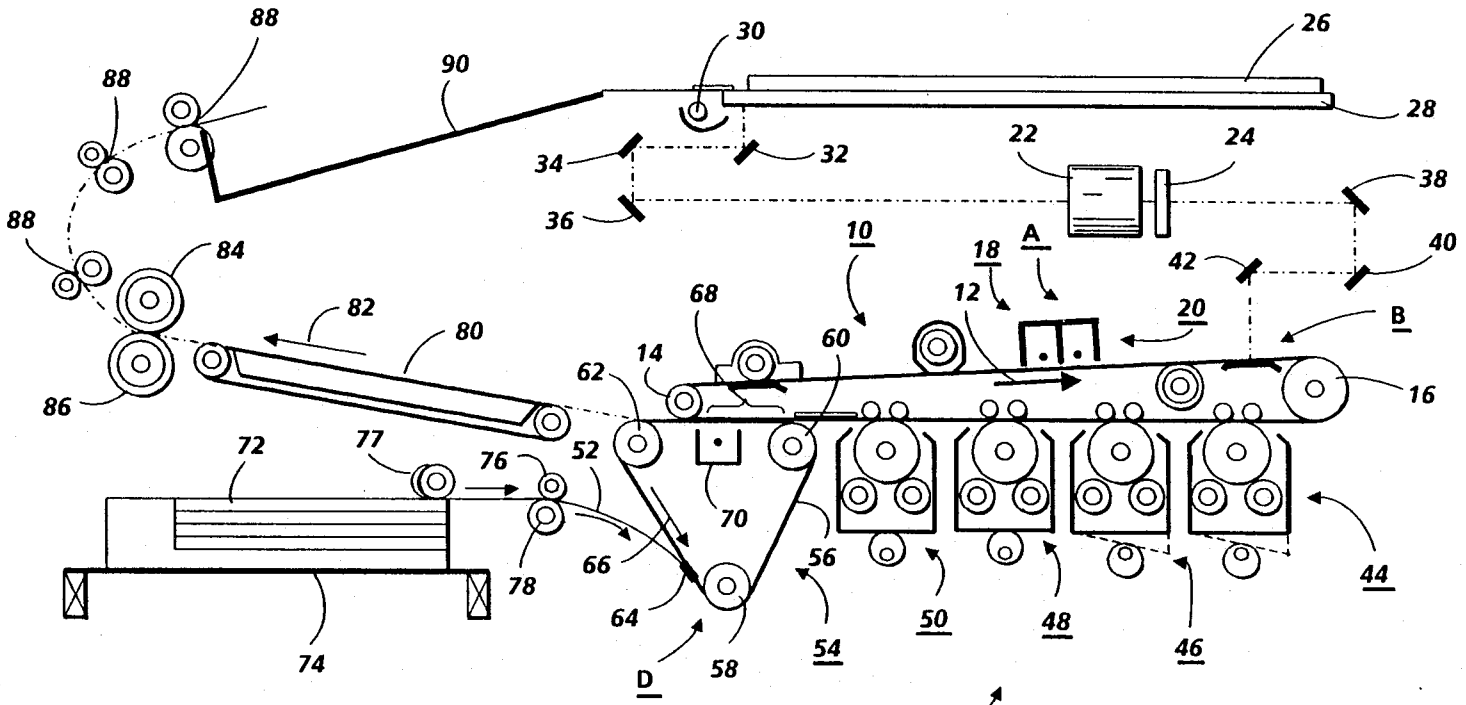
FIG. 1 is a schematic elevational view depicting an electrophotographic printing machine incorporating the sheet transport apparatus of the present invention therein.

For a general understanding of the features of the present invention, reference is made to the drawings. In the drawings, like references have been used throughout to designate identical elements. FIG. 1 schematically depicts the various components of an illustrative electrophotographic printing machine incorporating the sheet transport apparatus of the present invention therein. It will become evident from the following discussion that the sheet transport apparatus of the present invention is equally well suited for use in a wide variety of electrostatographic printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14 and drive roller 16. Stripping roller 14 is mounted rotatably so as to rotate with belt 10. Drive roller 14 is rotated by a motor coupled thereto by suitable means such as a belt drive. As roller 14 rotates, it advances belt 10 in the direction of arrow 12.

Initially, a portion of photoconductive belt 10 passes through charging station A. At charging station A, two corona generating devices, indicated generally by the reference numerals 18 and 20 charge photoconductive belt 10 to a relatively high, substantially uniform potential. Corona generating device 18 places all of the required charge on photoconductive belt 10. Corona generating device 20 acts as a leveling device, and fills in any areas missed by corona generating device 18.

Next, the charged photoconductive surface is rotated to exposure station B. Exposure station B includes a moving lens system, generally designated by the reference numeral 22, and a color filter mechanism, shown generally by the reference numeral 24. An original document 26 is supported stationarily upon a transparent viewing platen 28. Successive incremental areas of the original document are illuminated by means of a moving lamp assembly, shown generally by the reference numeral 30. Mirrors 32, 34 and 36 reflect the light rays through lens 22. Lens 22 is adapted to scan successive areas of illumination of platen 28. The light rays from lens 22 are reflected by mirrors 38, 40, and 42 to be focused on the charged portion of photoconductive belt 10. Lamp assembly 26, mirrors 32, 34 and 36, lens 22, and filter 24 are moved in a timed relationship with respect to the movement of photoconductive belt 10 to produce a flowing light image of the original document on photoconductive belt 10 in a non-distorted manner. During exposure, filter mechanism 24 interposes selected color filters into the optical light path of lens 22. The color filters operate on the light rays passing through the lens to record an electrostatic latent image, i.e. a latent electrostatic charge pattern, on the photoconductive belt corresponding to a specific color of the flowing light image of the original document.

Subsequent to the recording of the electrostatic latent image on photoconductive belt 10, belt 10 advances the electrostatic latent image to development station C. Development station C includes four individual developer units generally indicated by the reference numerals 44, 46, 48 and 50. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material.

The developer particles are continually moving so as to provide the brush consistently with fresh developer material. Development is achieved by bringing the brush of developer material into contact with the photoconductive surface. Each of the development units 44, 46 and 48, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum corresponding to the wave length of light transmitted through the filter. For example, an electrostatic latent image formed by passing the light image through a green filter will record the red and blue portions of the spectrums as areas of relatively high charge density on photoconductive belt 10, while the green light rays will pass through the filter and cause the charge density on the photoconductive belt 10 to be reduced to a voltage level ineffective for development. The charged areas are then made visible by having developer unit 44 apply green absorbing (magenta) toner particles onto the electrostatic latent image recorded on photoconductive belt 10. Similarly, a blue separation is developed by developer unit 46 with blue absorbing (yellow) toner particles, while the red separation is developed by developer unit 48 with red absorbing (cyan) toner particles. Developer unit 50 contains black toner particles and may be used to develop the electrostatic latent image formed from a black and white original document. Each of the developer units is cammed into and out of the operative position. In the operative position, the magnetic brush is closely adjacent the photoconductive belt, while, in the inoperative position, the magnetic brush is spaced therefrom. During development of each electrostatic latent image only one developer unit is in the operative position, the remaining developer units are in the inoperative position. This insures that each electrostatic latent image is developed with toner particles of the appropriate color without comingling. One skilled in the art will appreciate that while the developer units have been described as using a dry developer material, i.e. toner particles, a liquid may be employed. The term "toner image" is intended to cover both an image developed with a dry developer material or a liquid developer material.

After development, the toner image is moved to transfer station D where the toner image is transferred to a sheet of support material 52, such as plain paper amongst others. At transfer station D, the sheet transport apparatus of the present invention, indicated generally by the reference numeral 54, moves sheet 52 into contact with photoconductive belt 10. Sheet transport 54 has a pair of spaced belts 56 entrained about three rolls 58, 60 and 62. A gripper 64 extends between belts 56 and moves in unison therewith. Sheet 52 is advanced from a stack of sheets 72 disposed on tray 74. Feed roll 77 advances the uppermost sheet from stack 72 into the nip defined by forwarding rollers 76 and 78. Forwarding rollers 76 and 78 advance sheet 52 to sheet transport 54. Sheet 52 is advanced by forwarding rollers 76 and 78 in synchronism with the movement of gripper 64. In this way, the leading edge of sheet 52 arrives at a preselected position to be received by the open gripper 64. The gripper then closes securing the sheet thereto for movement therewith in a recirculating path. The leading edge of the sheet is secured releasably by gripper 64. As the belts move in the direction of arrow 66, the sheet 52 moves into contact with the photoconductive belt, in synchronism with the toner image developed thereon, at the transfer zone 68. A corona generating device sprays ions onto the backside of the sheet so as to charge the sheet to the proper magnitude and polarity for attracting the toner image from photoconductive belt 10 thereto. Sheet 52 remains secured to gripper 64 so as to move in a recirculating path for three cycles. In this way, three different color toner images are transferred to sheet 52 in superimposed registration with one another. Thus, the aforementioned steps of charging the photoconductive surface, exposing the photoconductive surface to a specific color of the flowing light image of the original document, developing the electrostatic latent image recorded on the photoconductive surface with appropriately colored toner, and transferring the toner images to the sheet of support material are repeated a plurality of cycles to form a multi-color copy of a colored original document. The detailed structure of sheet transport apparatus 54 will be described hereinafter with reference to FIGS. 2 through 4, inclusive.

After the last transfer operation, grippers 64 open and release sheet 52. Conveyor 80 transports sheet 52, in the direction of arrow 82, to fusing station E where the transferred image is permanently fused to sheet 52. Fusing station E includes a heated fuser roll 84 and a pressure roll 86. Sheet 52 passes through the nip defined by fuser roll 84 and pressure roll 86. The toner image contacts fuser roll 84 so as to be affixed to sheet 52. Thereafter, sheet 52 is advanced by forwarding roll pairs 88 to catch tray 90 for subsequent removal therefrom by the machine operator.

The last processing station in the direction of movement of belt 10, as indicated by arrow 12 is cleaning station F. A rotatably mounted fibrous brush 92 is positioned in cleaning station F and maintained in contact with photoconductive belt 10 to remove residual toner particles remaining after the transfer operation. Thereafter, lamp 94 illuminates photoconductive belt 10 to remove any residual charge remaining thereon prior to the start of the next successive cycle.

Figure 2:
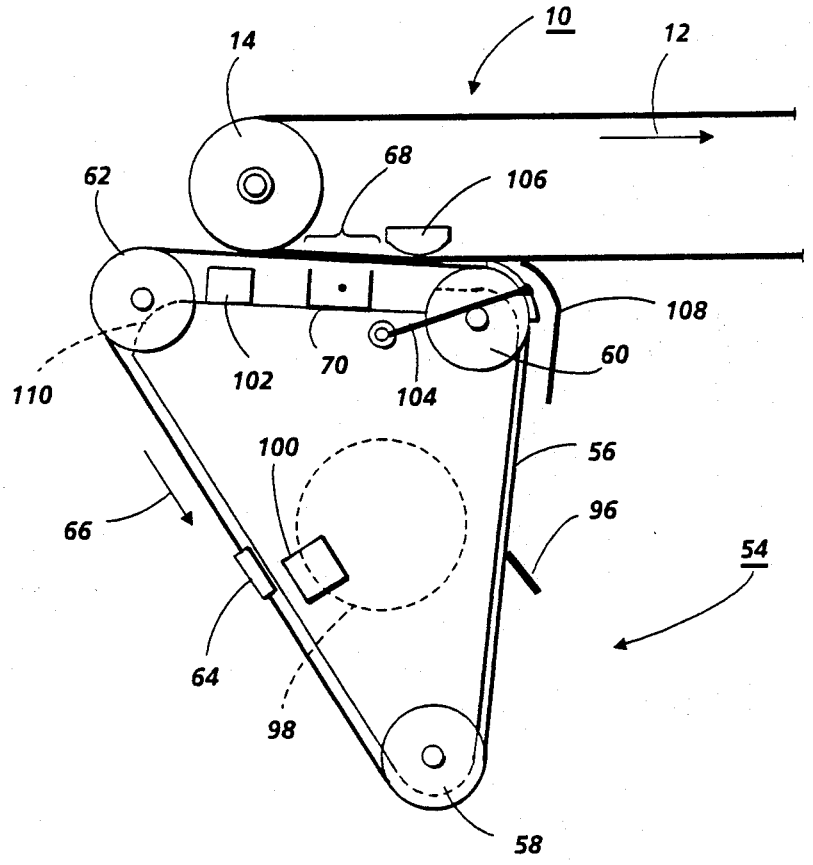
FIG. 2 is a schematic elevational view showing the sheet transport apparatus used in the FIG. 1 printing machine.

Referring now to FIG. 2, there is shown sheet transport 54 in greater detail. Sheet transport 54 includes two spaced belts 54. Each belt 56 is entrained about three spaced rolls 58, 60 and 62. A vacuum plenum 96 is disposed interiorly of and interposed between belts 56. Duct 98 connects plenum 96 with a fan for creating a low pressure at the vacuum ports in the plenum to hold a portion of sheet 52 thereagainst as it moves in a recirculating path. Gripper 64 is secured to belts 56 and moves in unison therewith. The gripper includes a bar extending between belts 56 in a direction substantially normal to the direction of movement of belts 56 and four magnetic clamps which are normally closed. Further details of gripper and the manner in which it is secured to belts 56 will be described hereinafter with reference to FIGS. 3 and 4. With continued reference to FIG. 2, electromagnets 100 and 102 are located at the sheet receiving position and the sheet release position, respectively. As gripper 64 passes electromagnet 100, the magnetic force of the electromagnet is greater than the magnetic force closing the clamps on the bar of the gripper 64. Thus, the clamps open to receive the leading edge of the sheet of support material 52 (FIG. 1). After the sheet transport 54 has recirculated the sheet of support material 52 the required number of cycles, e.g. three or four, electromagnet 102 is energized. As gripper 64 passes electromagnet 102, the magnetic force of the electromagnet is greater than the magnetic force closing the clamps on the bar of the gripper 64. Thus, the clamps open to release the leading edge of the sheet of support material 52. During each cycle, corona generating device 70 has attracted a different color toner image to the sheet. These toner images are transferred from photoconductive belt 10 to the sheet in superimposed registration with one anther. Hence, electromagnet 102 is energized after all of the toner images have been transferred to the sheet. The clamps of gripper 64 release the lead edge of the sheet and the sheet is advanced to fusing station E (FIG. 1). During transfer of the toner image from the photoconductive belt to the sheet of support material, a solenoid actuated pivotably mounted member 104 pivots in an upwardly direction to engage the trailing portion of the sheet and move it into contact with the photoconductive belt. Member 104 pivots after gripper 64 has passed thereover. Preferably, gripper 64 positions the lead edge of the sheet at a 7.5° angle which corresponds to the angle of the show 106 engaging the backside of the photoconductive belt in the region of the transfer zone 68. A small blower, preferably having a capacity of about 0.5 in. wg at about °cfm, is coupled to duct 98 so as to produce the required vacuum at the vacuum ports of plenum 96 to secure the trailing portion of the sheet thereto as it moves in a recirculating path. Gripper 64 drags the trailing portion of the sheet along plenum 96. A motor drive and encoder digital servo system are mounted interiorly of belts 56 and coupled to roll 58. In this way, actuation of the motor drives roll 58 to advance belts 56 in the direction of arrow 66. Any suitable motor drive and encoder may be used. By way of example, the motor drive and encoder are a Pittman Model No. 9434 motor with a standard 5.9:1 gear head and a Hewlitt Packard Model No. HEDS-5000 encoder. The motor digital servo system controls the gripper. The servo system matches the gripper position to the position of the photoconductive belt. The servo system also allows $8\frac{1}{2}\times 11$ inch sheets to have a shorter pitch length than $11\times 17$ inch sheets. This is done by speeding up the movement of the gripper after transfer. During transfer, when the sheet is moving through transfer zone 68, the gripper is moved at the same velocity as the photoconductive belt. Between successive toner image transfers, when the sheet is no longer in transfer zone 68, the gripper is moved at a greater velocity than the velocity of the photoconductive belt. The geometry of the sheet at the entrance to the transfer region is carefully controlled to prevent registration error. Important elements of this geometry are the gripper 64, show 106, pivotable member 106 and outer baffle 108. The geometry of the sheet, when it exits the transfer region, is carefully controlled to insure that the trailing edge of the sheet exits without smearing. This is achieved by eliminating the compressive forces on the sheet, i.e. preventing the sheet from buckling. This is accomplished by the inner baffle 110 and the servo system. Between transfers, i.e. when the sheet is not in the transfer zone 68, the sheet is controlled by a vacuum system to prevent smearing of the unfused image. The key elements are plenum 96 and the fan and duct system for producing the required vacuum at the vacuum ports of the plenum.

Figure 3:
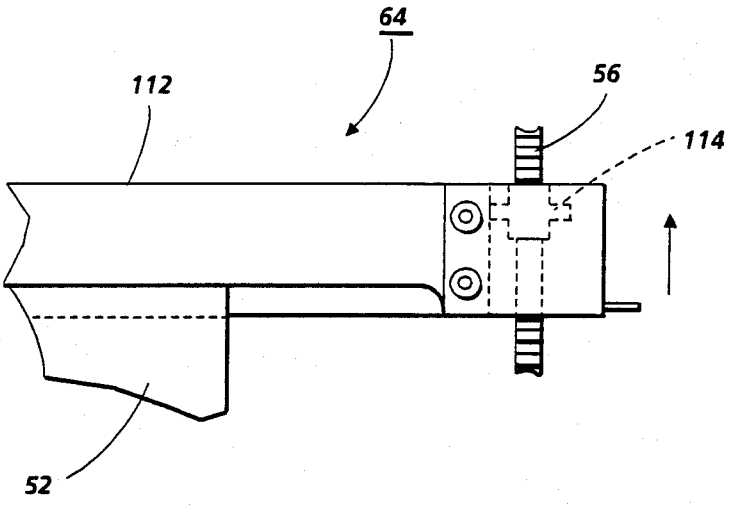
FIG. 3 is a fragmentary, plan view depicting the sheet gripper used in the FIG. 2 sheet transport apparatus.
Figure 4:
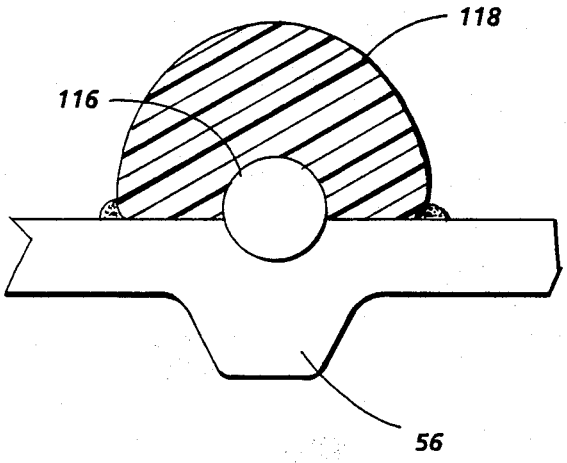
FIG. 4 is a fragmentary, elevational view showing the sheet gripper secured to a belt of the FIG. 2 sheet transport apparatus.

Turning now to FIGS. 3 and 4, there is shown the manner in which gripper 64 is mounted on belts 56. Gripper 64 has a bar 112 extending between belts 56. A permanent magnet, made from samariuim cobalt, is adhesively secured to the gripper bar to provide the normal force for gripping. There are four clamps. Each clamp is made from a soft, steel finger pivotably mounted on bar 112 over the magnet. Preferably, each steel finger is made from 1010 steel which has about a 12 to 15 kilo gauss saturation field. The gripping bar is driven by belts 56. The bar ends have a pin 114 which mounts slidably in opening 116 of horizontal boss 118 molded on belt 56. By way of example, boss 118 is molded from Plexiglas on belt 56. Belts 56 are timing belts.

While the sheet transport has been described as using a three roll system, one skilled in the art will appreciate that a two roll or four roll system may also be employed in lieu thereof.

In recapitulation, the sheet transport of the present invention employs a pair of spaced belts for advancing a gripper securing a sheet releasably in a recirculating path of movement. The belts move the gripper at the same speed as the photoconductive belt during transfer of the toner image from the photoconductive belt to the sheet of support material. During non-transfer of the toner image, the belts move the gripper at a greater speed than the photoconductive belt so as to increase efficiency and reduce the output time between copies.

It is, therefore, evident that there has been provided in accordance with the present invention, a sheet transport that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

We Claim:

1. An apparatus for advancing a sheet into registration with information developed on a moving member, including:

means for gripping the sheet;

belt means defining a continuous path, said gripping means being secured to said belt means to move in unison therewith; and means for moving said belt means so as to move the sheet in a recirculating path of movement, said moving means moving said belt means at a first velocity during registration of the sheet with the information of the moving member and at a second velocity during non-registration of the sheet with the information on the moving member.

2. An apparatus according to claim 1, further including means for transferring the developed information from the moving member to the sheet.

3. An apparatus according to claim 1, wherein the first velocity is substantially equal to the velocity of the moving member.

4. An apparatus according to claim 1, wherein the second velocity is greater than the first velocity.

5. An apparatus according to claim 1, wherein said moving means includes a plurality of spaced rolls with said belt means being entrained thereabout.

6. An apparatus according to claim 5, wherein said belt means includes two spaced belts entrained about said plurality of rolls.

7. An apparatus according to claim 6, wherein said gripping means includes:

a gripping bar extending across said spaced belts substantially normal to the direction of movement of said spaced belts; and at least one normally closed magnetic clamp mounted on said gripping bar for securing the leading edge of the sheet.

8. An apparatus according to claim 7, further including magnetic means opening said clamp at a first position to receive the leading edge of the sheet and at a second position to release the leading edge of the sheet.

9. An apparatus according to claim 8, wherein said magnetic means includes:

a first electromagnet located at the first position; and a second electromagnet located at the second position.

10. An apparatus according to claim 5, further including:

means, disposed internally of the path of movement of the sheet, for supporting the sheet over at least a portion of the path of movement thereof; and means for reducing the air pressure internally of said supporting means to attract the sheet thereto.

11. An apparatus according to claim 5, further including means for moving at least a portion of the sheet closely adjacent the moving member during registration of the sheet with the information developed on the moving member.

12. An apparatus according to claim 5, further including at least one baffle, mounted externally of the path of movement of the sheet in the region of one of said plurality of rolls, to guide the sheet along the path of movement.

13. An apparatus according to claim 5, wherein said plurality of rolls includes three spaced rolls associated with each of said spaced belts.

14. An apparatus according to claim 5, wherein said plurality of rolls includes two spaced rolls associated with each of said spaced belts.

15. A printing machine of the type having a toner image developed on a latent electrostatic charge pattern recorded on a moving member with a sheet being advanced into registration with the toner image, including:

means for gripping the sheet;

belt means defining a continuous path, said gripping means being secured to said belt means to move in unison therewith; and means for moving said belt means so as to move the sheet in a recirculating path of movement wherein said moving means moves said belt means at a first velocity during registration of the sheet with the toner image developed on the moving member and at a second velocity during non-registration of the sheet with the toner image developed on the moving member.

16. A printing machine according to claim 15, further including means for transferring the developed toner image from the moving member to the sheet.

17. A printing machine according to claim 16, wherein said transferring means transfers a plurality of different color toner images, in superimposed registration with one another, from the member to the sheet.

18. A printing machine according to claim 15, wherein the first velocity is substantially equal to the velocity of the moving member.

19. A printing machine according to claim 15, wherein the second velocity is greater than the first velocity.

20. A printing machine according to claim 15, wherein said moving means includes a plurality of spaced rolls with said belt means being entrained thereabout.

21. A printing machine according to claim 20, wherein said belt means includes two spaced belts entrained about said plurality of rolls.

22. A printing machine according to claim 21, wherein said gripping means includes:

a gripping bar extending across said spaced belts substantially normal to the direction of movement of said spaced belts; and at least one normally closed magnetic clamp mounted on said gripping bar for securing the leading edge of the sheet.

23. A printing machine according to claim 22, further including magnetic means opening said clamp at a first position to receive the leading edge of the sheet and at a second position to release the leading edge of the sheet.

24. A printing machine according to claim 23, wherein said magnetic means includes:

a first electromagnet located at the first position; and a second electromagnet located at the second position.

25. A printing machine according to claim 20, further including:

means, disposed internally of the path of movement of the sheet, for supporting the sheet over at least a portion of the path of movement thereof; and means for reducing the air pressure internally of said supporting means to attract the sheet thereto.

26. A printing machine according to claim 20, further including means for moving at least a portion of the sheet closely adjacent the moving member during registration of the sheet with the toner image developed on the moving member.

27. A printing machine according to claim 20, further including at least one baffle, mounted externally of the path of movement of the sheet in the region of one of said plurality of rolls, to guide the sheet along the path of movement.

28. A printing machine according to claim 20, wherein said plurality of rolls includes three spaced rolls associated with each of said spaced belts.

29. A printing machine according to claim 20, wherein said plurality of rolls includes two spaced rolls associated with each of said spaced belts.

* * * * *